United States Patent [19]

Honda

[11] Patent Number: 4,558,329

[45] Date of Patent: Dec. 10, 1985

[54] INK CARRIER RIBBON FOR SUBLIMATION TRANSFER

[75] Inventor: Sigemichi Honda, Tokyo, Japan

[73] Assignee: Sony Corporation, Tokyo, Japan

[21] Appl. No.: 609,081

[22] PCT Filed: Sep. 9, 1983

[86] PCT No.: PCT/JP83/00302

§ 371 Date: May 7, 1984

§ 102(e) Date: May 7, 1984

[87] PCT Pub. No.: WO84/00927

PCT Pub. Date: Mar. 15, 1984

[30] Foreign Application Priority Data

Sep. 9, 1982 [JP] Japan ..... 57-156980

[51] Int. Cl.[4] ..... B41J 35/16

[52] U.S. Cl. ..... 346/76 PH; 250/548; 400/241; 400/240.3; 346/106

[58] Field of Search ..... 400/240.3, 120, 249, 400/579, 580, 706, 708, 711, 241; 101/DIG. 7; 346/76 PH, 76 R, 135.1, 106; 271/227; 242/49, 57; 353/26 A; 226/45; 250/302, 548, 271, 338, 317.1

[56] References Cited

U.S. PATENT DOCUMENTS 4,219,737 8/1980 Gagnon et al. ..... 353/26 A

FOREIGN PATENT DOCUMENTS 57-8186A 1/1982 Japan ..... 346/76 PH 0193184 11/1983 Japan ..... 400/120

*Primary Examiner*—E. A. Goldberg

*Assistant Examiner*—A. Evans

*Attorney, Agent, or Firm*—Hill, Van Santen, Steadman & Simpson

[57] ABSTRACT

The present invention relates to an ink carrier ribbon for thermal-transfer printing capable of printing as a hard copy a still picture of various images such as a picture image picked up by, for example, a video camera, a television picture image or the like, and particularly to an ink carrier ribbon for sublimation transfer type hard copying which can produce, for example, a color copy by transferring a sublimation dye to a printing paper. In an ink carrier ribbon for sublimation transfer type hard copying in which thermal-transferable ink portions with a predetermined arrangement and a position detecting mark for the ink portions are formed on a base material, at least one ink portion of the ink portions and the position detecting mark are formed of composition which contains dispersion dye, binder and pigment which is thermally stable and has absorbing property for infrared rays. Thus, without special printing process, it is possible to form the position detecting mark at the same time when the ink portion of each color is formed to thereby to make it form the mark at the precise position without increasing the working process.

7 Claims, 3 Drawing Figures

INK CARRIER RIBBON FOR SUBLIMATION TRANSFER

DESCRIPTION

1. Technical Field

The present invention relates to an ink carrier ribbon for thermal-transfer recording capable of printing as a hard copy a still picture of various images such as a picture image picked up by, for example, a video camera, a television picture image or the like and particularly to an ink carrier ribbon for sublimation transfer type hard copy which can produce, for example, a color hard copy by transferring a sublimation dye from the ink carrier ribbon to a printing paper.

2. Background Art

An outline of such a sublimation transfer type color hard copy system will be described with reference to FIG. 1. In this case, a printing paper 1 is wrapped around a platen 2 which rotates in the direction shown by an arrow a, while a thermal print head 4 is disposed so as to press an ink carrier ribbon 3 for thermal transfer printing against the platen. Heating elements 4*a* the number of which corresponds to the number of picture elements in one scanning line of, for example, a television picture are arrayed, on the tip end of the thermal print head 4.

The ink carrier ribbon 3 closely pressed between the thermal print head 4 and the printing paper 1 is formed of, for example, as shown in FIG. 2, a sheet-like base material 9 and ink portions each containing sublimation dyes of yellow, magenta, cyan and black, or ink portions each containing sublimation dye of yellow Y, magenta M, cyan C and black B, each ink portion having a configuration corresponding to that of a picture screen of a television picture and being repeatedly arranged in turn on the base material. In this case, ink portion position detecting marks 5Y, 5M, 5C and 5B of respective colors used for detecting the positions of the respective color ink portions are formed on one corresponding side edges of the respective ink portions and a block position detecting mark 6 is formed on the other side edge to detect the ink portions of each group, namely, a combined block of adjoining ink portions Y, M, C and B.

Under the condition that the ink portion Y, for example, is pressed against the printing paper 1, on the basis of information signal corresponding to yellow, for example, a color signal corresponding to yellow of a television video signal, respective head elements 4*a* of the head 4 are heated with a pattern corresponding to the picture elements of one scanning line so that the yellow sublimation dye on the ink portion Y is thermally transferred to the printing paper 1 in accordance with the heated pattern. As described above, the platen 2 is intermittently rotated along the arrow a at every line corresponding to each scanning line to thermally transfer the information of each line, and the yellow sublimation dye of one picture amount is transferred by one revolution of the platen 2. As to the magenta M, the similar transfer process is carried out and as to the cyan C and the black B the similar transfer thereof are repeatedly carried out to thereby sequentially superpose the transferred images of the sublimation dyes of yellow Y, magenta M, cyan C and black B, whereby a color image is produced on the printing paper. In this case, there are provided detecting means for detecting the marks 5(5Y, 5M, 5C and 5B) and 6 so as to allow the signals corresponding to the respective color signals in the ink portions Y, M, C and B to be supplied to the head elements 4*a* of the head 4. The detecting means is formed of, for example, as shown in FIG. 1 a light source 7 for detective light rays, for example, infrared light ray emission diode and a photo detector 8 for detecting the detective light rays, which are disposed on the both sides of the ink carrier ribbon 3 at which the marks 5 and 6 are formed in correspondence thereto. On the basis of the presence or absence of the marks 5 and 6, the detected signals are developed from the detector 8 whereby to detect the position of the ink carrier ribbon 3 relative to the thermal print head 4.

The marks 5 and 6 in the ink carrier ribbon 3 used in such transfer system may be formed of, for example, a carbon coated film having a shield effect for the infrared ray emitted from the diode 7 as, for example, the detecting light source 7 by printing. However, in practice, since the ink portions Y, M, C and B having sublimation dyes of respective colors in the ink carrier ribbon 3 are formed by repeatedly printing the respective inks, and the printing of the position detecting marks 5 and 6 in addition thereto causes not only the manufacturing process thereof quite complicated but also a problem of the matching in the positions of the repetitive printings. Thus, the factors for causing the positional displacement therebetween are increased and thereby a color picture image of high color purity and excellent quality is obstructed from being transferred.

The present invention is to provide an ink carrier ribbon for sublimation transfer type hard copying by which the color copy, for example, can be produced by transferring the above sublimation dyes, and in which a position detecting mark of each ink portion or a position detecting mark of a combined block portion of respective ink portions can surely be formed at a predetermined position without particular process and with high precision.

DISCLOSURE OF INVENTION

According to the present invention, in the ink carrier ribbon for sublimation transfer type hard copying wherein a thermal transferable ink portion with a predetermined arrangement and a position detecting mark for detecting the ink portion are formed on a base material, at least one color ink portion and the position detecting mark therefor are formed of an ink coated layer which contains a dispersing dye of this color, a binder and also a pigment, for example, carbon which is thermally stable and has an absorbing property for the position detecting light, for example, the infrared ray.

BEST MODE FOR CARRYING OUT THE INVENTION

Figure 2:
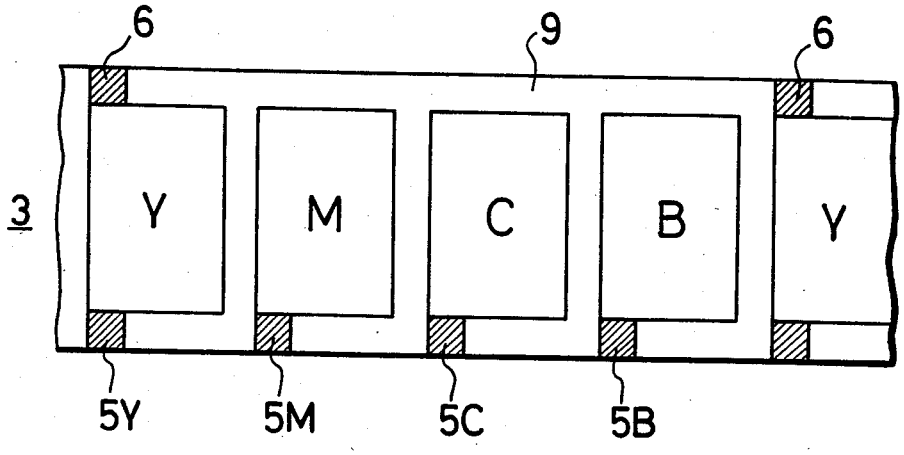
FIG. 2 is a schematically enlarged diagram of an example of an ink carrier ribbon for sublimation transfer type hard copying to which the present invention can be applied.

A description will be given to an embodiment in which the present invention is applied to the ink carrier ribbon 3 with the structure as shown in FIG. 2. In this embodiment, on the base material 9 the ink portions of a plurality kinds of colors, namely, the yellow ink portion Y, the magenta ink portion M, the cyan ink portion C and the black ink portion B are repeatedly arranged in turn on the marks 5Y, 5M, 5C and 5B for detecting the respective positions of ink portions Y, M, C and B are formed on one side thereof at predetermined positions, for example, the tip end edge positions of the respective ink portions in correspondence with the respective ink portions Y, M, C and B, and the block position detecting mark 6 is formed on the tip end ink portion of each block formed of the ink portions Y, M, C and B, in the illustrative example, at the predetermined position of the other side of the yellow portion Y, for example, the tip end edge position of the yellow portion Y to detect the block position.

In the present invention, the yellow ink portion Y to be transferred, the position detecting mark 5Y thereof to be provided in correspondence with the ink portion Y and the block position detecting mark 6 are formed simultaneously by, for example, printing using a first ink paint of the same composition.

The magenta ink portion M to be transferred and the position detecting mark 5M to be provided in correspondence therewith are formed simultaneously by, for example, printing using a second ink paint of the same composition.

Similarly, the cyan ink portion C to be transferred and the position detecting mark 5C to be provided in correspondence therewith are formed simultaneously by, for example, printing using a third ink paint of the same composition.

Further, similarly, the black ink portion B to be transferred and the position detecting mark 5B to be provided in correspondence therewith are formed simultaneously by, for example, printing using a fourth ink paint of the same composition.

It is needless to say that the order of the printing on the above portions using the first to fourth ink paints can be selected arbitrarily.

Each composition of the first to fourth ink paints is made by mixing the sublimation dispersion dye of each color, the binder, the solvent and the pigment which can absorb the detecting light, for example, the infrared ray. It is, however, desired that the coating amount of the dye is selected in a range from 0.1 to 5 $g/m^2$ and that a ratio D/Bi between the amount D (weight) of the dye and the amount Bi (weight) of the binder is selected in a range from 1/5 to 1. The mixing amount of the solvent is selected such that the ink paint may have an appropriate viscosity for printing. It is desired to select the coating amount of the pigment, which has the absorbing property for the infrared ray, for example, the carbon to be 0.2 $g/m^2$ or above. The upper limit of the adding amount of the pigment is selected such that upon printing the ink paint may have the viscosity so as not to cause a so-called ink shortage and the amount thereof is selected so as not to cause the coating speed to be lowered to prevent the ink shortage. The above adding amount concerns the amount of the solvent and it is desired that such adding amount is generally selected to be 5 $g/m^2$ or below, more preferably below 2 $g/m^2$.

Organic dye of relatively small molecular amount (for example, about 200 to 400) may be used as the sublimation dye and hence this organic dye is included much in a known dispersion dye. The sublimation dye used here is evaporated from solid or liquid at the temperature of approximately 100° to 200° C. and can be transferred and dyed to polyester resin, epoxy resin, cellulose acetate, nylon resin, acetate or the like. In chemical structure, dye such as azo-series, anthraquinone-series, styryl-series, quinophthalone-series, nitrodiphenylamine-series or the like can mainly be exemplified as such sublimation dye.

Any one of known natural or synthetic binder resin used in the paint for offset printing or gravure printing may be used as the binder in the ink paint.

As the solvent, in addition to water, various solvents such as alcohol-series, aromatic-series, aliphatic-series, naphtane-series, isoparafin-series, ester-series and ketone-series can be used solely or the mixture thereof.

As the pigment having the absorbing property of the infrared ray, it is desired to use inorganic pigment such as metal oxide, for example, iron oxide or metal powder or the like other than the above carbon. That is, since such inorganic pigment is stable against heat, the inorganic pigment is never transferred to the printing paper by heating by the head 4 but can stably be held on the transfer ink ribbon side without being transferred therefrom.

EXAMPLE 1 dispersion dye having sublimation property (KAYASET RED, manufactured by NIPPON KAYAKU CO., LTD): 6 weight % hydroxy propyl cellulose: 6 weight % ethyl cellulose: 5 weight % carbon black (average particle diameter, 100 μm): 5 weight % isopropyl alcohol: 78 weight %

The ink paint of the magenta color M was formed by mixing the above compositions.

Instead of the dye in the composition of the above magenta ink paint, KAYASET YELLOW AG (manufactured by NIPPON KAYAKU CO., LTD.) was used to provide the yellow ink paint.

Instead of the dye in the composition of the above magenta ink paint, KAYASET BLUE FR (trade name, manufactured by NIPPON KAYAKU CO., LTD.) was used to provide the cyan ink paint.

Instead of the dye in the composition of the above magenta ink paint, KAYASET BLACK 922 (trade name, manufactured by NIPPON KAYAKU CO., LTD.) was used to provide the black ink paint.

The above magenta, yellow, cyan and black ink paints were respectively coated on a condenser paper of 20 μm thick by using a 3-step gravure coater. At that time, the coating amount of the dispersing dye was about 0.6 $g/m^2$ and that of the carbon black was about 0.58 $g/m^2$.

Figure 3:
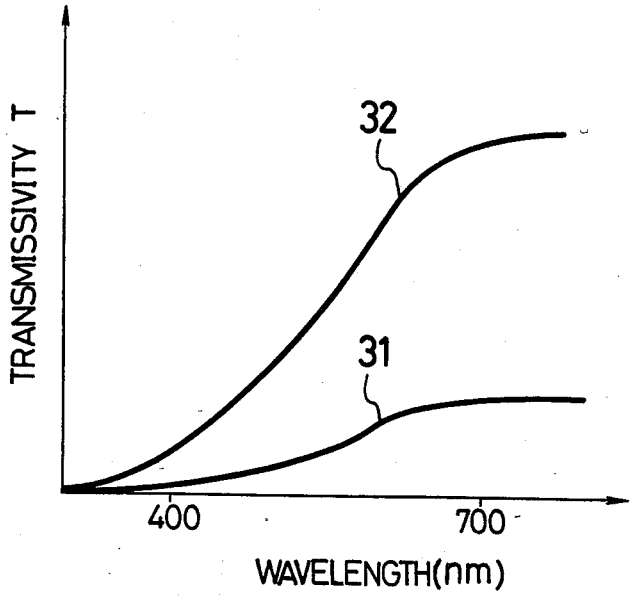
FIG. 3 is a graph showing the light transmissivity to wavelength characteristics.

Dependency of the light transmissivity T of each of the ink portions and the position detecting marks on the wavelength was measured and the measured results were shown by a curve 31 in FIG. 3. In this graph, a curve 32 shows results of dependency measured when the carbon which absorbs the infrared ray was not added to the paint.

Figure 1:
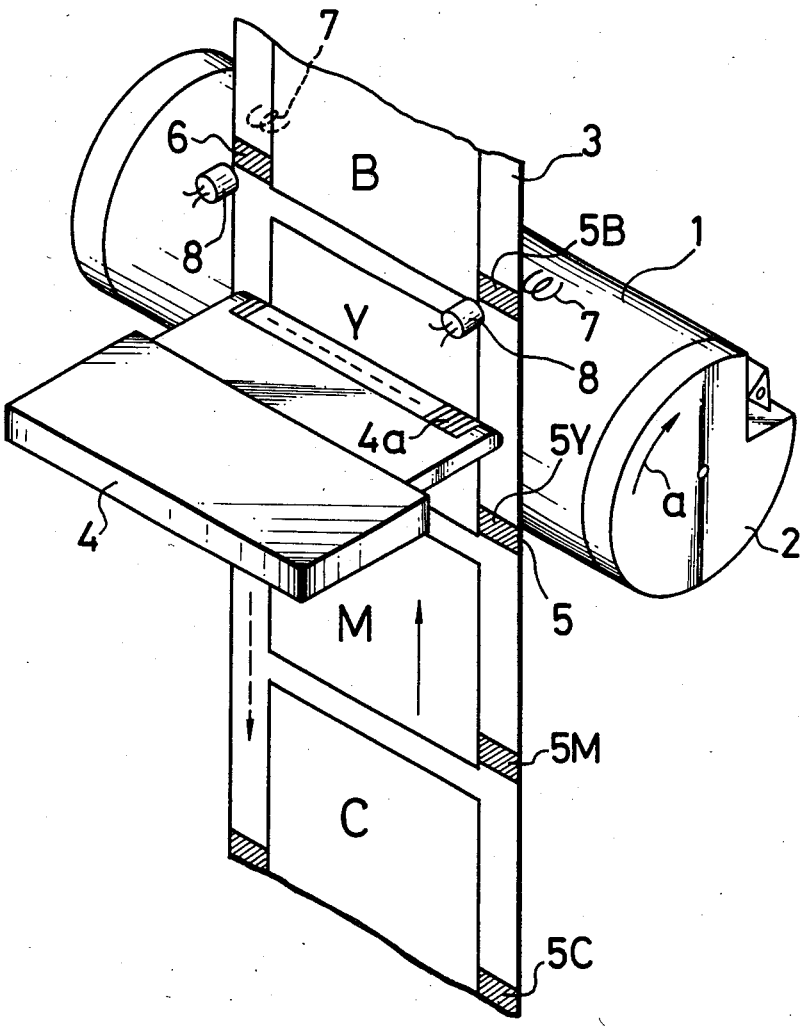
FIG. 1 is a constructional diagram of a main part of a sublimation dye transfer type printer useful for explaining the present invention.

The ink ribbon for thermal transfer printing made according to the example 1 is pressed between the head 4 and the printing paper 1 as shown in FIG. 1 and then the dye thereof is transferred to the printing paper.

In this case, it is generally desired that the printing paper to be used is made of paper, more preferably paper with the thickness of about 20 to 60 μm and the area weight of the range from about 15 to 35 $g/m^2$. And also it is desired that the surface of the above paper is coated with polyester resin, cellulose acetate, nylon resin, epoxy resin or the like, each having excellent dyeing property for the sublimation dye.

According to the ink ribbon of the present invention, the position detecting marks 5 and 6 are not formed by the special printing process but formed by printing at the same time when the respective color ink portions Y, M, C and B are formed. Thus, the positional relation among the respective ink portions and the respective position marks 5 and 6 can be set with accuracy and the number of the printing work processes can be prevented from being increased by the provision of the position detecting marks 5 and 6. Therefore, the ink ribbon of the present invention has excellent productivity and a large industrial advantage.

While in the above example each mark 5 is formed on the position different from the portions Y, M, C and B which should be transferred, the pigment which can absorb the detecting light is contained in the respective portions Y, M, C and B so that in some case, these portions Y, M, C and B themselves have the function same as that of mark 5. Further, regarding the block position detecting mark 6, if the wavelength of the detecting light therefor is changed from that for the mark 5 and the pigment having the absorbing property for the former detecting light is also contained in, for example, the portion Y, the portion Y itself can have the function same as that of the mark 6.

In some case, it is not necessary to provide the mark 5 (5Y, 5M, 5C and 5B) in response to each color. That is, when the mutual positional relation among the respective ink portions Y, M, C and B is set with high accuracy, it is possible to provide, for example, only the block position detecting mark 6. In this case, the pigment having the absorbing property of the detecting light is added to a single portion, for example, only the portion Y, while it becomes not necessary to add the pigment to other portions M, C and B.

While in the above example the respective ink portions are formed of the combination of yellow, magenta, cyan and black, it is clear that the present invention can be applied to the case of the combination of various colors.

I claim:

1. An ink carrier ribbon for sublimation transfer type hard copying comprising:

a base;

a plurality of thermally transferable ink portions formed on said base with a predetermined arrangement; and a position detecting mark for said ink portions adjoining at least a portion of said plurality of ink portions, at least one of said ink portions and said position detecting mark being formed of ink compositions identical with each other, said ink compositions being composed of a dispersion dye, a binder, and a pigment having thermally stable characteristics and an absorbing property for infrared rays.

2. An ink carrier ribbon for sublimation transfer type hard copying comprising:

a base;

a plurality of colors of thermally transferable ink portions formed repetitively on said base with a predetermined arrangement;

a position detecting mark formed on said base and provided contiguously to at least a portion of said ink portions;

said ink portions and said position detecting mark being formed of identical ink compositions, said ink compositions being composed of a dispersion dye, a binder, and a pigment having thermally stable characteristics upon heating for thermal transfer of a sublimable dye and an absorbing property for infrared rays.

3. An ink carrier ribbon for sublimation transfer type hard copying according to claim 1 or 2, in which said ink portions are formed of ink portions of three colors, yellow, magenta and cyan.

4. An ink carrier ribbon for sublimation transfer type hard copying according to claim 1 or 2, in which said pigment is made of carbon.

5. An ink carrier ribbon for sublimation transfer type hard copying according to claim 1 or 2, in which said dye is coated with amount of a range from 0.1 to 5 $g/m^2$.

6. An ink carrier ribbon for sublimation transfer type hard copying according to claim 1 or 2, in which said pigment is present in an amount of 0.2 $g/m^2$ or above.

7. In an ink carrier ribbon for sublimation transfer type hard copying in which an ink ribbon has sublimation transfer property ink portions formed on a base material with a predetermined arrangement which are heated while in contact with a printing paper to thereby transfer a dispersing dye contained in said ink portions to said printing paper, said ink carrier ribbon for sublimation transfer type hard copying being characterized in that said ink ribbon is provided with said ink portions in a predetermined arrangement and a position detecting mark and that at least one ink portion of said ink portions and said position detecting mark are composed of identical ink compositions containing a dispersing dye, a binder and a pigment which has an absorbing property for infrared rays and is thermally stable.

* * * * *